United States Patent [19]

Fetters

[11] Patent Number: 4,743,579

[45] Date of Patent: May 10, 1988

[54] RECORDING SHEET HAVING A CHLORINATED ALPHA-OLEFIN SOLVENT

[75] Inventor: Robert A. Fetters, Chillicothe, Ohio

[73] Assignee: The Mead Corporation, Dayton, Ohio

[21] Appl. No.: 27,376

[22] Filed: Mar. 18, 1987

[51] Int. Cl.[4] ..... B41M 5/16; B41M 5/22

[52] U.S. Cl. ..... 503/213; 427/150; 427/151; 428/402.2; 428/402.21; 428/402.22; 428/914; 503/215

[58] Field of Search ..... 427/150–152; 428/402.21, 402.22, 913, 914, 321.5, 402; 503/209, 213, 215, 225

[56] References Cited

U.S. PATENT DOCUMENTS 4,234,213 11/1980 Skees ..... 503/213

*Primary Examiner*—Bruce H. Hess

*Attorney, Agent, or Firm*—Smith & Schnacke

[57] ABSTRACT

A recording sheet is provided having a support with a layer of microcapsules on the surface thereof. The microcapsules contain a substantially colorless electron donating color former and a chlorinated alpha-olefin as a solvent for the color former.

10 Claims, No Drawings

RECORDING SHEET HAVING A CHLORINATED ALPHA-OLEFIN SOLVENT

BACKGROUND OF THE INVENTION

The present invention relates to a recording sheet comprising a support and microcapsules containing a color former and a solvent therefor, and more particularly, to a recording sheet having a chlorinated alpha-olefin as the solvent for the color former.

Much time has been devoted to the development of recording systems wherein particular electron donating organic compounds possessing the capability of forming a color (hereinafter color former) on reaction with an acidic electron accepting compound (hereinafter color developer) are employed. These recording systems include pressure sensitive recording systems, heat sensitive recording systems, etc. For examples of these recording systems, see U.S. Pat. Nos. 2,712,507; 2,730,456; 2,730,457; 3,418,250 and 3,432,327. These systems involve a combination of a so called CB (coated back) sheet prepared by coating on a support a layer of microcapsules produced by microencapsulating oil droplets of a color former and a so-called CF (coated front) sheet prepared by coating a color developer on another sheet. In a pressure sensitive transfer recording system, the CB and CF sheets are superposed so that the microcapsule layer and the color developer layer are in contact with each other. Upon the application of pressure, the microcapsules are ruptured which releases the color former. The color former then reacts with the color developer to produce a coloration in the areas to which the pressure has been applied. In a self-contained system, a single sheet is prepared by coating one side of a support with a layer of the above-described microcapsules and a color developer.

Suitable solvents for effective use in recording systems must readily and easily dissolve the color former to be used, contribute effectively to formation of a high density coloration, exhibit low toxicity, have no unpleasant smell, have a high boiling point so as not to vaporize in a heat drying process and in a place of elevated temperature, and have a low viscosity so that the effusion thereof from the microcapsules can be freely done upon microcapsule rupture. Specific examples of solvents for the color formers employed in the aforementioned record papers include alkyl naphthylenes, alkylated diphenylalkanes, alkylated triphenyldimethanes, alkylated diphenyls, kerosene, chlorinated diphenyls, chlorinated paraffins and natural oils such as cottonseed oil, soybean oil, corn oil, olive oil, castor oil, fish oil, lard oil, and linseed oil.

SUMMARY OF THE INVENTION

The present invention provides a recording sheet comprising a support having a layer of microcapsules on the surface thereof wherein the microcapsules contain a substantially colorless electron donating color former and a chlorinated alpha-olefin as the solvent for the color former. The chlorinated alpha-olefin can be used neat or in combination with suitable diluents such as aliphatics or alkylated benzene. It has been found that chlorinated alpha-olefins are preferred to solvents such as chlorinated paraffins. Chlorinated paraffins typically contain over 400 different chlorination products. Many of these products have an unpleasant odor which is released when the microcapsules are ruptured. Chlorinated alpha-olefins are obtained from a purer starting material than chlorinated paraffins and, due to their specific chlorination sites (i.e. the 1-and 2- positions), provide a cleaner product with a much improved odor level. Additionally, aromatic fractions which are found in the paraffins are not present. Thus, the present invention overcomes the disadvantages associated with the use of chlorinated paraffin as a carbonless solvent.

Thus, an object of the present invention is to provide a solvent for color formers which is a purer product than the chlorinated paraffin substitution product.

A further object of the present invention is to provide a carbonless solvent which has an improved odor level and no toxicity.

Other objects and advantages of the present invention will be apparent from the following description and the appended claims

DETAILED DESCRIPTION OF INVENTION

To be useful as the solvent of the present invention, the chlorinated alpha-olefin must be liquid at room temperature or be liquid in combination with a diluent. Chlorinated alpha-olefins useful in the present invention have a melting point in the range of about −20° to 10° C., about 8 to 20 carbon atoms and preferably, about 12 to 14 carbon atoms, and a chlorine content of about 35 to 60 wt. %, and preferably, about 40 to 45 wt. %.

The viscosity of the alpha-olefin must be sufficiently low to provide efficient transfer of the color former to a receiver sheet. If it is too high a diluent may be mixed with the alpha-olefin.

If the chlorinated alpha-olefin is used in combination with a diluent, the choice and amount of diluent are determined by the color former and the developer solubility. The choice of chlorinated alpha-olefin also influences the diluent choice and amount; for example, as the chlorine content and chain length of the chlorinated alpha-olefin increases, the viscosity of the oil mix increases and thus, the amount of diluent needed to effect reasonable transfer increases.

Known encapsulation techniques can be employed to encapsulate the solvent of the color former in the present invention. For example, a suitable technique is a coacervation process as disclosed in U.S. Pat. Nos. 2,730,456; 2,800,457 and 2,800,458. Further techniques utilize a deposition of a polymer as disclosed in U.S. Pat. Nos. 3,418,250 and 3,660,304. Still another technique utilizes a polymerization of reactants occurring in oil droplets as disclosed in U.S. Pat. Nos. 3,726,804 and 3,796,669. Of these techniques, techniques utilizing a deposition of a polymer and utilizing a polymerization of reactants occurring in oil droplets are particularly effective when applied to the encapsulation of the solvent of the present invention. A preferred encapsulation technique is the formation of urea-formaldehyde or melamine-formaldehyde microcapsules walls. Suitable methods are described in U.S. Pat. Nos. 4,001,140; 4,087,376 4,089,802 to Foris et al; 4,251,386 and 4,356,109 to Saeki et al.; 4,297,235 to Hoshi et al.; and 3,886,085 to Kiritani et al.

A suitable concentration of the color former in the solvent can range from about 1 to 30% by weight, and preferably, about 2 to 15% by weight based on the total weight of the solvent or oil mix.

Typical examples of organic color formers, which can be employed in the present invention, include triarylmethane type compounds, diphenylmethane type compounds, xanthene type compounds, thiazine type compounds and spiropryan type compounds as described in U.S. Pat. No. 3,970,769 and British Pat. No. 1,392,946. Specific examples of these color formers are illustrated below.

Specific examples of triarylmethane type color formers include 3,3-bis(p-dimethylaminophenyl)-6-dimethylaminophthalide (Crystal Violet Lactone, hereinafter CVL);
3,3-bis(p-dimethylaminophenyl)-3-(1,2-dimethylindole-3-yl) phthalide;
3-(p-dimethylaminophenyl)-3-(2-methylindole-3-yl) phthalide;
3-(p-dimethylaminophenyl)-3-(2-phenylindole-3-yl)phthalide;
3,3-bis(1,2-dimethylindole-3-yl)-5-dimethylaminophthalide;
3,3-bis(1,2-dimethylindole-3-yl)-6-dimethylaminophthalide;
3,3-bis(9-ethylcarbazole-3-yl)-5-dimethylaminophthalide;
3,3-bis(2-phenylindole-3-yl)-5-dimethylaminophthalide; and
3-p-dimethylaminophenyl-3-(1-methylpyrrole-2-yl)-6-dimethylaminophthalide.

Specific examples of diphenylmethane type color formers include 4,4'-bis-dimethylaminobenzhydrine benzyl ether; N-halophenyl leuco Auramine; and N-2,4,5-trichlorophenyl leuco Auramine.

Specific examples of xanthane type color formers include

Rhodamine-B-anilinolactam;
Rhodamine-(p-nitroanilino)lactam;
Rhodamine B(p-chloroanilino)lactam;
3-dimethylamino-6-methoxyfluoran;
3-diethylamino-7-methoxyfluoran;
3-diethylamino-7-chloro-6-methylfluoran;
3-diethylamino-7-(acetylmethylamino)fluoran;
3-diethylamino-7-(dibenzylamino)-fluoran;
3-diethylamino-7-(methylbenzylamino)fluoran;
3-diethylamino-7-(chloroethylmethylamino)fluoran; and
3-diethylamino-7-(diethylamino)fluoran.

Specific examples of color formers of the thiazine type include benzoyl leuco methylene blue and p-nitrobenzyl leuco methylene blue.

Specific examples of color formers of the spiro type include 3-methyl-spiro-dinaphthopyran;
3-ethylspirodinaphthopyran;
3,3'-dichloro-spiro-dinaphthopyran;
3-methylnaphtho-(3-methoxy-benzo)-spiropyran; and
3-propyl-spiro-di-benzodipyran.

Typically, supports useful in the present invention are paper such as commercial impact raw stock or coated and uncoated carbonizing bonds.

Examples of useful developers include acid clay, active clay, attapulgite, bentonite, zeolite and other active clays; organic acid materials such as phenolic resins; and metal salts of aromatic carboxylic acids such as zinc salts of di-alpha-methylbenzyl salicylic acid. See U.S. Pat. Nos. 4,612,254; 4,173,684; 4,134,847; 3,924,027; and 3,737,410 Typically, the color developer is used in an amount of about 0.1 to 10 grams/$m^2$ of the support.

Other additives such as binders, antioxidants, smudge-preventing agents and surface active agents are well known and described in U.S. Pat. Nos. 2,711,375 and 3,625,736; British Pat. No. 1,232,347; Japanese patent Applications Nos. (OPI) 44,012/75; 50,112/75; 127,718/75 and 30,615/75; and U.S. Pat. Nos. 3,836,383 and 3,846,331.

The present invention is illustrated in more detail by the following non-limiting examples.

EXAMPLE

A protective colloid (sulphonated polystyrene) solution was prepared as follows. 24 g of Versa TL-500 in 319 g water was adjusted to a pH of 3.2 with aqueous 10% sulfuric acid and then mixed for one hour to release carbon dioxide (degas). After adjustment, the final pH was 6.0.

The oil/dye solution was prepared by mixing the following components: 267.0 g chlorinated alpha-olefin (solvent), 218.4 g kerosene (diluent), 4.062 g blue color precursor, 1.332 g red color precursor, 2.730 g orange color precursor, 12.186 g green color precursor, and 12.186 g black color precursor. The chlorinated alpha-olefin was produced by Occidental Chemical Co. and identified as Chlorowax 45AO which is a C-12 alpha-olefin with approximately 42% chlorine content, a specific gravity of 1.1, and a 0.18 poise viscosity at 25° C. The solution was heated to 90°-100° C. to throughly mix the color precursors in the solvent/diluent. The solution was held for at least 30 minutes at this temperature and then cooled to 50° C.

The wall-former was prepared as follows: 30 g melamine was added to 150 g water to which 50 g formalin (37%) had been added. The mixture was heated to about 65° C. for 30 minutes.

518 g oil/dy solution was emulsified (mixed with mechanical agitation) into 343 g protective colloid solution. The rate of addition and mixing speed were adjusted to obtain the particle size desired. The emulsion was poured off into the reactor and the vessel was rinsed with water.

240 g wall-former solution at 30° to 35° C. was added to the emulsion in the reactor. The pH of the solution was adjusted to 6.0. The emulsion was heated to 65° C. The temperature rise was regulated so as to bring the temperature to 65° C. in 30 to 40 minutes at which time the emulsion was held for 90 minutes to cure the microcapsules.

At the end of the heating/cure time, the pH of the emulsion was adjusted to 3.8 with aqueous sulfuric acid and a scavenging material was added to scavenge the excess formalin. The emulsion was held at 65° C. for 40 minutes. At the end of the scavenging period, the pH was adjusted to 10.0 by addition of 10% NaOH.

Having described the invention in detail and by reference to preferred embodiments thereof, it will be apparent that modifications and variations are possible without departing from the scope of the invention defined in the appended claims.

What is claimed is:

1. A recording sheet comprising a support having a layer of microcapsules on the surface thereof, said microcapsules containing a substantially colorless electron donating color former and a chlorinated alpha-olefin as a solvent for said color former.

2. The recording sheet of claim 1 wherein said chlorinated alpha-olefin solvent has about 8 to 20 carbon atoms.

3. The recording sheet of claim 2 wherein said chlorinated alpha-olefin solvent has a chlorine weight % of about 35 to 60.

4. The recording sheet of claim 3 wherein said sheet additionally comprises a developer material capable of reacting with said color former to form a visible image codeposited on said support with said microcapsules containing said color former and said solvent.

5. The recording sheet of claim 4 wherein said microcapsules additionally contain a diluent.

6. The recording sheet of claim 1 wherein said microcapsule is formed from a melamine-formaldehyde or a urea-formaldehyde resin.

7. A microcapsule comprising an internal phase enwrapped in a polymeric wall material, said internal phase including a color former and a solvent for said color former, said solvent being a chlorinated alpha-olefin.

8. The microcapsule of claim 5 wherein said internal phase additionally includes a diluent.

9. The microcapsules of claim 5 wherein said wall material is melamine-formaldehyde or urea-formaldehyde resin.

10. The microcapsules of claim 5 wherein said wall material is gelatin.

* * * * *